US007125016B1

(12) United States Patent
Schmidt et al.

(10) Patent No.: US 7,125,016 B1
(45) Date of Patent: Oct. 24, 2006

(54) BOARD GAME

(76) Inventors: Kathleen A. Schmidt, 1 Hampton Dr., Weaverville, NC (US) 28787; Joseph R. Schmidt, 1 Hampton Dr., Weaverville, NC (US) 28787

( * ) Notice: Subject to any disclaimer, the term of this patent is extended or adjusted under 35 U.S.C. 154(b) by 0 days.

(21) Appl. No.: 11/009,345

(22) Filed: Dec. 10, 2004

(51) Int. Cl.
*A63F 3/00* (2006.01)

(52) U.S. Cl. ..... 273/243; 273/287

(58) Field of Classification Search ..... 273/287, 273/243

See application file for complete search history.

(56) References Cited

U.S. PATENT DOCUMENTS 4,209,085 A * 6/1980 Kozan ..... 190/109
4,283,059 A 8/1981 Beeder
4,696,473 A * 9/1987 Wyzykowski ..... 273/153 R
4,832,347 A 5/1989 Monticolombi
4,979,749 A * 12/1990 Onanian ..... 273/282.1
5,139,266 A 8/1992 Mullins et al.
5,429,371 A 7/1995 Bledsoe
5,505,455 A * 4/1996 Kamrath et al. ..... 273/248
5,505,456 A 4/1996 Schmidt
5,547,198 A * 8/1996 Kaiser ..... 273/243
D380,780 S 7/1997 Capote
6,082,545 A * 7/2000 Ford et al. ..... 206/579
6,315,293 B1 * 11/2001 Bush ..... 273/244.1

* cited by examiner

*Primary Examiner*—Vishu K. Mendiratta

(57) ABSTRACT

A board game includes a portable housing formed from water-impermeable material and having walls sized and shaped for defining a generally rectangular shape. Selected ones of the walls define a lower section having a cavity formed therebetween. A top one of the walls is pivotally connected to the lower section for shielding the cavity. A game board is included that is formed from water-impermeable material and has surface indicia for defining a game path and a plurality of spaces on which each player may land. The board game further includes a plurality of game pieces, a dry-erase board, and a dry-erase marker removably positionable within the cavity. The dry-erase board has a substantially smooth drawing surface connected to the top wall and facing away therefrom.

18 Claims, 2 Drawing Sheets

BOARD GAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a board game and, more particularly, to a board game for providing entertainment to a group of players.

2. Prior Art

The use of board games as a means of entertainment is well known in the prior art. In general the game includes a board defining a track of adjacent spaces to be occupied by playing pieces, a plurality of playing pieces to be moved from space to space by players, and a random number generator to indicate the number of spaces the playing pieces can be moved.

Usually such board games are played upon a table with competing players seated around the table. This method of play unfortunately does not allow for any physical movement of the players, and may become mundane, especially for younger players. Sports activities, on the other hand, tend to have practices that are repetitive and so physically taxing that the participants get no enjoyment therefrom. This is especially true of swimming, where practices consist mostly of doing laps back and forth in a pool. It would thus be advantageous to have a means to play a game that can be incorporated into such swimming practices.

Board games known in the prior art tend to have cardboard based construction, thus limiting their use to dry/indoor areas. This unfortunately limits the conditions under which such a game can be played.

Accordingly, a need remains for a board game in order to overcome the above noted shortcomings. The present invention satisfies such a need by providing a board game that is easy to play, competitive in nature, fun and entertaining, and makes workouts more enjoyable. Such a board game provides a fun and competitive activity that not only encourages athletes to work in teams, but also gives participants something to look forward to at practice. This advantageously keeps the swimmers interested in the sport and focused during practices, thus resulting in improved performances during actual competitions. The waterproof components of the board game advantageously allows for game play in the wet environment where swim practices tend to take place. Such a board game is fun, competitive, skill-enhancing, team-building, convenient and durable for years of effective use.

BRIEF SUMMARY OF THE INVENTION

In view of the foregoing background, it is therefore an object of the present invention to provide a game board. These and other objects, features, and advantages of the invention are provided by a board game for providing entertainment to a group of players.

The board game includes a portable housing advantageously formed from water-impermeable material including polyvinylchloride. Such a housing has a plurality of walls sized and shaped for defining a generally rectangular shape. Selected ones of the walls are integrally mated for defining a lower section having a cavity formed therebetween. A top one of the walls is pivotally connected to the lower section and conveniently movable between open and closed positions for effectively shielding the cavity from undesirable foreign debris.

The top wall may further include a plurality of articulated flap portions connected to an outer perimeter of the top surface. Such an outer perimeter has a plurality of creases for defining lines of weakness about which the flap portions are conveniently pivotal. Selected ones of the flap portions are removably positionable intermediate of the game board and associated ones of the lower section walls such that the housing can advantageously be maintained at a closed position during non-playing conditions.

The present invention further includes a game board that is formed from water-impermeable material including polyvinylchloride. Such a game board has surface indicia for defining a game path along which players must travel. The game path defines a starting position wherein each player travels in a clockwise pattern therefrom. The surface indicia illustrate a plurality of spaces on which each player may land wherein each space defines and instructs the players to perform a predetermined swimming activity during each round of play.

The game board preferably includes a substantially planar top surface and a plurality of sides integrally connected thereto. Such a top surface has a centrally disposed longitudinal axis wherein the sides are equidistantly and oppositely spaced therefrom and are adjustably positionable adjacent to a group of the lower section walls such that the sides become situated substantially parallel to the lower section walls during playing conditions. The top surface extends above the cavity and is disposed along a substantially horizontal plane along the lower section so that the game pieces (described herein below) can advantageously be removably stored within the cavity during non-playing conditions.

The game board preferably further includes a spinner rotatably connected to the top surface and positioned medially of the game path. Such a spinner is provided with a plurality of wedge-shaped surface indicia that identify a number of spaces the players may advance during each round of play.

A plurality of game pieces are included and have shapes representative of a swimming icon selected from the group including a diving position, a free-style position, a stop watch and a pair of fins. Of course, alternately shaped game pieces may be used as is obvious to an individual skilled in the art.

A dry-erase board and a dry-erase marker are removably positionable within the cavity. Such a dry-erase board has a substantially smooth drawing surface connected to the top wall and facing away therefrom such that each player can conveniently keep track of an associated score during game play. The dry-erase board may have a plurality of outer edge portions extending substantially parallel to the lines of weakness respectively such that the dry-erase board can advantageously be maintained along a linear plane when the top wall is biased to the closed position.

The board game preferably further includes a handle having opposed end portions secured to the lower section and extending substantially parallel to a horizontal plane such that the housing can conveniently be transported along an upright position. Another one of the flap portions is provided with an elongated slot sized and shaped for receiving the handle therethrough when the top wall is biased to the closed position.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
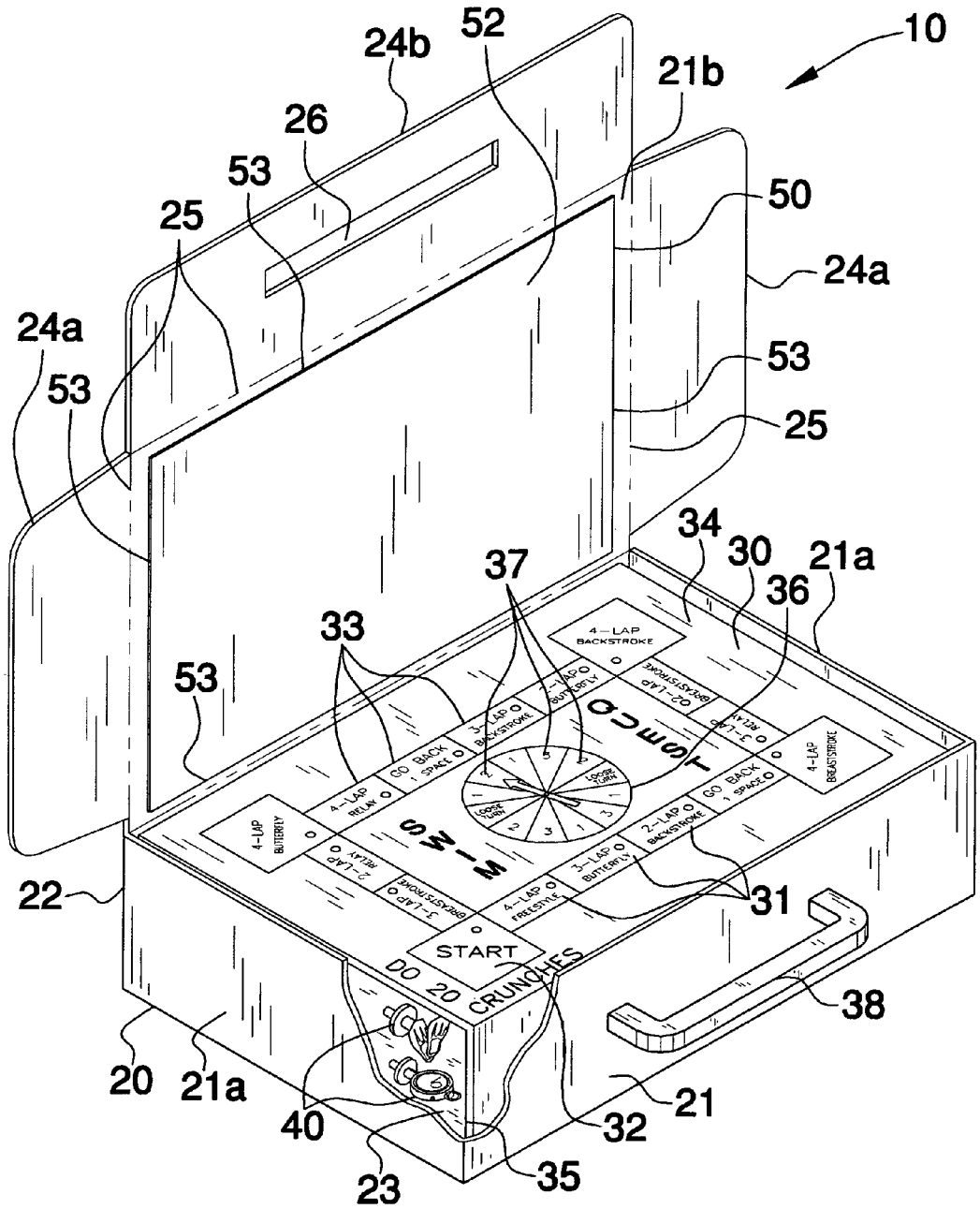
FIG. 1 is a perspective view showing a board game, in accordance with the present invention.
Figure 2:
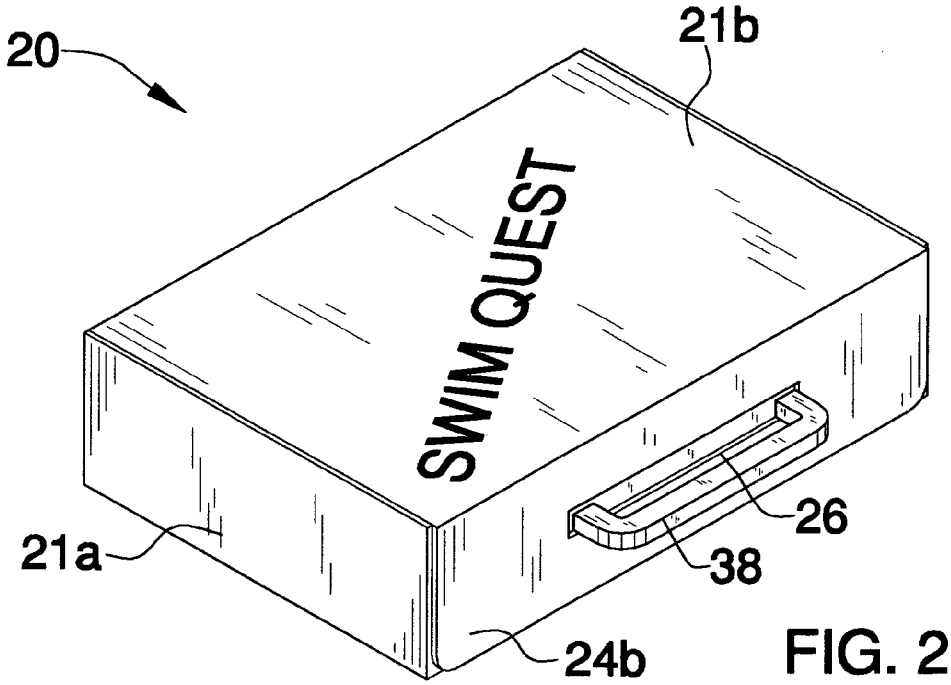
FIG. 2 is a perspective view of the board game shown in FIG. 1, showing the portable housing at a closed position.
Figure 3:
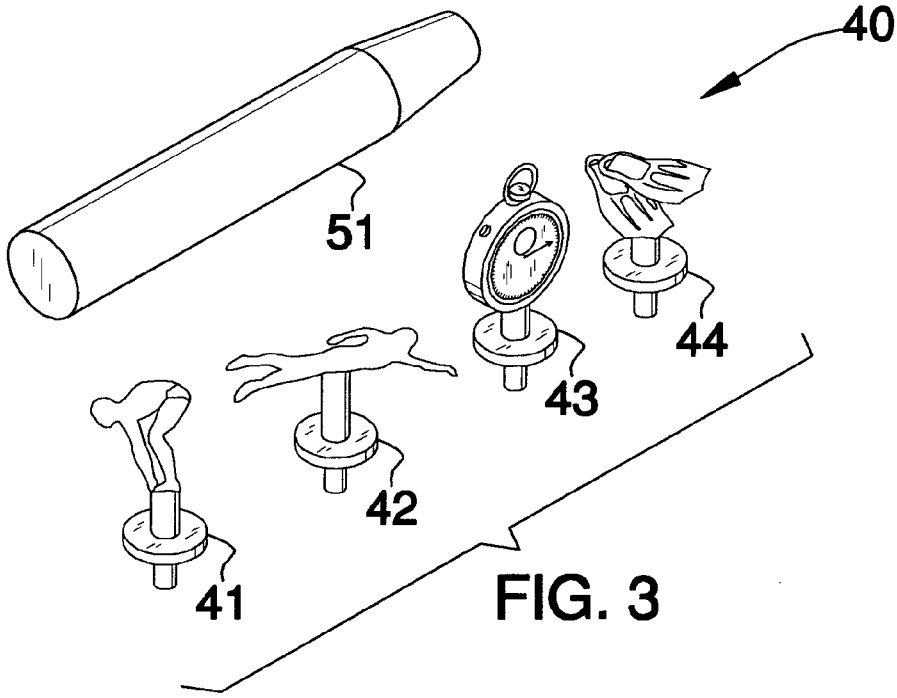
FIG. 3 is a perspective view showing a plurality of game pieces and a dry erase marker.

The assembly of this invention is referred to generally in FIGS. 1–3 by the reference numeral 10 and is intended to provide a board game. It should be understood that the assembly 10 may be used during practice sessions of many different types of sports and should not be limited to use only during swimming practices.

Referring initially to FIGS. 1 and 2, the assembly 10 includes a portable housing 20 advantageously formed from water-impermeable material including polyvinylchloride, thus allowing the housing 20 to be placed in an environment that may become wet without causing damage to the contents therein. Such a housing 20 has a plurality of walls 21 sized and shaped for defining a generally rectangular shape. Selected ones 21A of the walls 21 are integrally mated for defining a lower section 22 having a cavity 23 formed therebetween. A top one of the walls 21B is pivotally connected to the lower section 22 and conveniently movable between open and closed positions for effectively shielding the cavity 23 from undesirable foreign debris.

Referring to FIGS. 1 and 2, the top wall 21B further includes a plurality of articulated flap portions 24 connected to an outer perimeter of the top wall 21B. Such an outer perimeter has a plurality of creases 25 for defining lines of weakness about which the flap portions 24 are conveniently pivotal. Selected ones of the flap portions 24A are removably positionable intermediate of the game board 30 (described herein below) and associated ones of the lower section walls 21A such that the housing 20 can advantageously be maintained at a closed position during non-playing conditions.

Referring to FIG. 1, the present invention further includes a game board 30 that is formed from water-impermeable material including polyvinylchloride, thus advantageously allowing the game board 30 to be placed in an environment that may become wet without causing damage thereto. Such a game board 30 has surface indicia 31 for defining a game path along which players must travel. The game path defines a starting position 32 wherein each player travels in a clockwise pattern therefrom. The surface indicia 31 illustrate a plurality of spaces 33 on which each player may land wherein each space 33 defines and instructs the players to perform a predetermined swimming activity during each round of play. Of course, such spaces 33 may instruct players to perform predetermined activities for alternate sports as well, such as soccer or football, as is obvious to a person of ordinary skill in the art.

Still referring to FIG. 1, the game board 30 includes a substantially planar top surface 34 and a plurality of sides 35 integrally connected thereto. Such a top surface 34 has a centrally disposed longitudinal axis wherein the sides 35 are equidistantly and oppositely spaced therefrom and are adjustably positionable adjacent to a group of the lower section walls 21A such that the sides 35 become situated substantially parallel to the lower section walls 21A during playing conditions. The top surface 34 extends above the cavity 23 and is disposed along a substantially horizontal plane along the lower section 22 so that the game pieces 40 (described herein below) can advantageously be removably stored within the cavity 23 during non-playing conditions. This feature advantageously ensures that the game pieces 40 will not be misplaced and further conveniently facilitates their transport from one location to another.

Still referring to FIG. 1, the game board 30 further includes a spinner 36 rotatably connected to the top surface 34 and positioned medially of the game path. Such a spinner 36 is provided with a plurality of wedge-shaped surface indicia 37 that identify a number of spaces 33 the players may advance during each round of play. Since the indicia 37 are selected at random a player does not know which space 33 they will land on, and thus do not know which activity they will be asked perform. This advantageously ensures that their sports practice is always an exciting and novel experience, which will further prevent boredom due to repetitive practices.

Referring to FIG. 3, a plurality of game pieces 40 are included and have shapes representative of a swimming icon selected from the group including a diving position 41, a free-style position 42, a stop watch 43 and a pair of fins 44. Of course, alternately shaped game pieces 40, representing alternative sports, may be used as is obvious to an individual skilled in the art.

Referring to FIGS. 1 and 3, a dry-erase board 50 and a dry-erase marker 51 are removably positionable within the cavity 23. Such a dry-erase board 50 has a substantially smooth drawing surface 52 connected to the top wall 21B and facing away therefrom such that each player can conveniently keep track of an associated score during game play. The dry-erase board 50 has a plurality of outer edge portions 53 extending substantially parallel to the lines of weakness 25 respectively such that the dry-erase board 50 can advantageously be maintained along a linear plane when the top wall 21B is biased to the closed position.

Referring to FIGS. 1 and 2, the board game 30 further includes a handle 38 having opposed end portions secured to the lower section 22 and extending substantially parallel to a horizontal plane such that the housing 20 can conveniently be transported along an upright position. Another one of the flap portions 24B is provided with an elongated slot 26 sized and shaped for receiving the handle 38 therethrough when the top wall 21B is biased to the closed position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A board game for providing entertainment to a group of players, said board game comprising:

a portable housing having a plurality of walls sized and shaped for defining a generally rectangular shape, selected ones of said walls being integrally mated for defining a lower section having a cavity formed therebetween, a top one of said walls being pivotally connected to said lower section and movable between open and closed positions for shielding the cavity from undesirable foreign debris;

a game board having surface indicia for defining a game path along which players must travel, said game path defining a starting position wherein each player travels in a clockwise pattern therefrom, said surface indicia illustrating a plurality of spaces on which each player may land wherein each space defines and instructs the players to perform a predetermined swimming activity during each round of play;

a plurality of game pieces having shapes representative of a swimming icon selected from the group including a diving position, a free-style position, a stop watch and a pair of fins; and a dry-erase board and a dry-erase marker removably positionable within the cavity, said dry-erase board having a substantially smooth drawing surface connected to said top wall and facing away therefrom such that each player can keep track of an associated score during game play.

2. The board game of claim 1, wherein said game board comprises:

a substantially planar top surface and a plurality of sides integrally connected thereto, said top surface having a centrally disposed longitudinal axis wherein said sides are equidistantly and oppositely spaced therefrom, said sides being adjustably positionable adjacent to a group of said lower section walls such that said sides become situated substantially parallel to said lower section walls during playing conditions, said top surface extending above the cavity and being disposed along a substantially horizontal plane along said lower section so that said game pieces can be removably stored within the cavity during non-playing conditions.

3. The board game of claim 2, wherein said top surface further comprises:

a plurality of articulated flap portions connected to an outer perimeter of said top surface, said outer perimeter having a plurality of creases for defining lines of weakness about which said flap portions are pivotal, selected ones of said flap portions being removably positionable intermediate of said game board and associated ones of said lower section walls such that said housing can be maintained at a closed position during non-playing conditions.

4. The board game of claim 3, further comprising:

a handle having opposed end portions secured to said lower section and extending substantially parallel to a horizontal plane such that said housing can be transported along an upright position, another one of said flap portions being provided with an elongated slot sized and shaped for receiving said handle therethrough when said top wall is biased to the closed position.

5. The board game of claim 1, wherein said game board further comprises:

a spinner rotatably connected to said top surface and positioned medially of said game path, said spinner being provided with surface indicia that identifies a number of spaces the players may advance during each round of play.

6. The board game of claim 3, wherein said dry-erase board has a plurality of outer edge portions extending substantially parallel to the lines of weakness respectively such that said dry-erase board can be maintained along a linear plane when said top wall is biased to the closed position.

7. A board game for providing entertainment to a group of players, said board game comprising:

a portable housing formed from water-impermeable material and having a plurality of walls sized and shaped for defining a generally rectangular shape, selected ones of said walls being integrally mated for defining a lower section having a cavity formed therebetween, a top one of said walls being pivotally connected to said lower section and movable between open and closed positions for shielding the cavity from undesirable foreign debris;

a game board formed from water-impermeable material and having surface indicia for defining a game path along which players must travel, said game path defining a starting position wherein each player travels in a clockwise pattern therefrom, said surface indicia illustrating a plurality of spaces on which each player may land wherein each space defines and instructs the players to perform a predetermined swimming activity during each round of play;

a plurality of game pieces having shapes representative of a swimming icon selected from the group including a diving position, a free-style position, a stop watch and a pair of fins; and a dry-erase board and a dry-erase marker removably positionable within the cavity, said dry-erase board having a substantially smooth drawing surface connected to said top wall and facing away therefrom such that each player can keep track of an associated score during game play.

8. The board game of claim 7, wherein said game board comprises:

a substantially planar top surface and a plurality of sides integrally connected thereto, said top surface having a centrally disposed longitudinal axis wherein said sides are equidistantly and oppositely spaced therefrom, said sides being adjustably positionable adjacent to a group of said lower section walls such that said sides become situated substantially parallel to said lower section walls during playing conditions, said top surface extending above the cavity and being disposed along a substantially horizontal plane along said lower section so that said game pieces can be removably stored within the cavity during non-playing conditions.

9. The board game of claim 8, wherein said top surface further comprises:

a plurality of articulated flap portions connected to an outer perimeter of said top surface, said outer perimeter having a plurality of creases for defining lines of weakness about which said flap portions are pivotal, selected ones of said flap portions being removably positionable intermediate of said game board and associated ones of said lower section walls such that said housing can be maintained at a closed position during non-playing conditions.

10. The board game of claim 9, further comprising:

a handle having opposed end portions secured to said lower section and extending substantially parallel to a horizontal plane such that said housing can be transported along an upright position, another one of said flap portions being provided with an elongated slot sized and shaped for receiving said handle therethrough when said top wall is biased to the closed position.

11. The board game of claim 7, wherein said game board further comprises:

a spinner rotatably connected to said top surface and positioned medially of said game path, said spinner being provided with surface indicia that identifies a number of spaces the players may advance during each round of play.

12. The board game of claim 9, wherein said dry-erase board has a plurality of outer edge portions extending substantially parallel to the lines of weakness respectively such that said dry-erase board can be maintained along a linear plane when said top wall is biased to the closed position.

13. A board game for providing entertainment to a group of players, said board game comprising:

a portable housing formed from water-impermeable material including polyvinylchloride, said housing having a plurality of walls sized and shaped for defining a generally rectangular shape, selected ones of said walls being integrally mated for defining a lower section having a cavity formed therebetween, a top one of said walls being pivotally connected to said lower section and movable between open and closed positions for shielding the cavity from undesirable foreign debris;

a game board formed from water-impermeable material including polyvinylchloride, said game board having surface indicia for defining a game path along which players must travel, said game path defining a starting position wherein each player travels in a clockwise pattern therefrom, said surface indicia illustrating a plurality of spaces on which each player may land wherein each space defines and instructs the players to perform a predetermined swimming activity during each round of play;

a plurality of game pieces having shapes representative of a swimming icon selected from the group including a diving position, a free-style position, a stop watch and a pair of fins; and a dry-erase board and a dry-erase marker removably positionable within the cavity, said dry-erase board having a substantially smooth drawing surface connected to said top wall and facing away therefrom such that each player can keep track of an associated score during game play.

14. The board game of claim 13, wherein said game board comprises:

a substantially planar top surface and a plurality of sides integrally connected thereto, said top surface having a centrally disposed longitudinal axis wherein said sides are equidistantly and oppositely spaced therefrom, said sides being adjustably positionable adjacent to a group of said lower section walls such that said sides become situated substantially parallel to said lower section walls during playing conditions, said top surface extending above the cavity and being disposed along a substantially horizontal plane along said lower section so that said game pieces can be removably stored within the cavity during non-playing conditions.

15. The board game of claim 14, wherein said top surface further comprises:

a plurality of articulated flap portions connected to an outer perimeter of said top surface, said outer perimeter having a plurality of creases for defining lines of weakness about which said flap portions are pivotal, selected ones of said flap portions being removably positionable intermediate of said game board and associated ones of said lower section walls such that said housing can be maintained at a closed position during non-playing conditions.

16. The board game of claim 15, further comprising:

a handle having opposed end portions secured to said lower section and extending substantially parallel to a horizontal plane such that said housing can be transported along an upright position, another one of said flap portions being provided with an elongated slot sized and shaped for receiving said handle therethrough when said top wall is biased to the closed position.

17. The board game of claim 13, wherein said game board further comprises:

a spinner rotatably connected to said top surface and positioned medially of said game path, said spinner being provided with a plurality of wedge-shaped surface indicia that identifies a number of spaces the players may advance during each round of play.

18. The board game of claim 15, wherein said dry-erase board has a plurality of outer edge portions extending substantially parallel to the lines of weakness respectively such that said dry-erase board can be maintained along a linear plane when said top wall is biased to the closed position.

* * * * *